US006443822B1

(12) United States Patent
Ball

(10) Patent No.: US 6,443,822 B1
(45) Date of Patent: Sep. 3, 2002

(54) WAFER PROCESSING APPARATUS

(75) Inventor: Michael Byan Ball, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 77 days.

(21) Appl. No.: 09/651,325

(22) Filed: Aug. 30, 2000

Related U.S. Application Data

(60) Continuation of application No. 09/322,520, filed on May 28, 1999, now Pat. No. 6,234,874, which is a division of application No. 09/002,759, filed on Jul. 5, 1998, now Pat. No. 6,074,286.

(51) Int. Cl.[7] ..... B24B 5/00

(52) U.S. Cl. ..... 451/287; 451/285; 451/41; 451/548

(58) Field of Search ..... 451/287, 28, 41, 451/63, 268, 269, 270, 285, 288, 289, 286, 398, 548, 550, 539; 51/295, 298, 293

(56) References Cited

U.S. PATENT DOCUMENTS

| | | | | | |
|---|---|---|---|---|---|
| 4,918,872 | A | * | 4/1990 | Sato et al. | 451/548 |
| 5,011,513 | A | * | 4/1991 | Zador et al. | 51/295 |
| 5,036,630 | A | * | 8/1991 | Kaanta et al. | 451/41 |
| 5,076,024 | A | | 12/1991 | Akagawa et al. | |
| 5,174,795 | A | * | 12/1992 | Wiand | 51/295 |
| 5,329,734 | A | | 7/1994 | Yu | |
| 5,394,655 | A | | 3/1995 | Allen et al. | |
| 5,486,131 | A | * | 1/1996 | Cesna et al. | 451/548 |
| 5,536,202 | A | * | 7/1996 | Appel et al. | 451/287 |
| 5,609,719 | A | | 3/1997 | Hempel | |
| 5,643,406 | A | | 7/1997 | Shimomura et al. | |
| 5,645,469 | A | | 7/1997 | Burke et al. | |
| 5,671,725 | A | * | 9/1997 | Dishaw | 125/21 |
| 5,692,950 | A | | 12/1997 | Rutherford et al. | |
| 5,759,088 | A | | 6/1998 | Kondratenko | |
| 5,791,969 | A | | 8/1998 | Lund | |
| 5,860,851 | A | | 1/1999 | Beppu et al. | |
| 5,882,251 | A | | 3/1999 | Berman et al. | |
| 5,934,980 | A | | 8/1999 | Koos et al. | |
| 6,056,631 | A | | 5/2000 | Brown et al. | |
| 6,071,816 | A | | 6/2000 | Watts et al. | |
| 6,077,581 | A | | 6/2000 | Kuramochi et al. | |
| 6,161,533 | A | | 12/2000 | Katsumata et al. | |
| 6,234,874 | B1 | | 5/2001 | Ball | |

* cited by examiner

*Primary Examiner*—Joseph J. Hail, III
*Assistant Examiner*—Hadi Shakeri
(74) *Attorney, Agent, or Firm*—Killworth, Gottman, Hagan & Schaeff LLP

(57) ABSTRACT

A wafer processing apparatus and method of processing a wafer utilizing a processing slurry are provided. The wafer processing disk comprises a processing disk body and a plurality of processing teeth secured to the processing disk body. The plurality of processing teeth project from the disk body to define respective processing surfaces. The plurality of processing teeth include at least one pair of spaced adjacent teeth defining a processing channel there between. The processing channel is shaped such that the cross sectional area of the processing channel decreases as a function of its distance from the processing disk body. The method of processing the wafer surface comprises the steps of: positioning a processing disk adjacent the wafer surface; causing the processing disk to move relative to the wafer surface; distributing a first processing slurry over the wafer surface as the processing disk moves relative to the wafer surface, wherein the first processing slurry comprises a first processing fluid and coarse processing particles; and, distributing a second processing slurry over the wafer surface as the processing disk moves relative to the wafer surface, wherein the second processing slurry comprises a second processing fluid and fine processing particles, wherein the coarse processing particles are larger than the fine processing particles.

20 Claims, 4 Drawing Sheets

WAFER PROCESSING APPARATUS

CROSS REFERENCE TO RELATED APPLICATIONS

This application is a continuation of U.S. patent application Ser. No. 09/322,520, filed May 28, 1999, now U.S. Pat. No. 6,234,874, which is a division of U.S. patent application Ser. No. 09/002,759, filed Jan. 5, 1998, now U.S. Pat. No. 6,074,286. This application is also related to U.S. patent application Ser. No. 09/322,629, filed May 28, 1999, now U.S. Pat. No. 6,116,988, which is a division of U.S. patent application Ser. No. 09/002,759, filed Jan. 5, 1998, now U.S. Pat. No. 6,074,286. This application is also related to U.S. patent application Ser. No. 09/653,097, filed Aug. 31, 2000, which is a continuation of U.S. patent application Ser. No. 09/322,520, filed May 28, 1999, now U.S. Pat. No. 6,234,874, which is a division of U.S. patent application Ser. No. 09/002,759, filed Jan. 5, 1998, now U.S. Pat. No. 6,074,286.

BACKGROUND OF THE INVENTION

The present invention relates to a method and an apparatus for processing wafers, e.g., semiconductor wafers, utilizing a wafer processing disk.

A microchip or integrated circuit formed on a wafer surface must be separated from the wafer surface, which typically contains an array of integrated circuits, and put in a protective package. Semiconductor wafer packaging has traditionally lagged behind wafer fabrication in process sophistication and manufacturing demands. The advent of the VLSI-ULSI era in chip density has forced a radical upgrading of chip packaging technology and production automation. It is a widely held belief in the art that eventually packaging will be the limiting factor on the growth of chip size. Accordingly, much effort is going into new package designs, new material development, and faster and more reliable packaging processes.

It is often necessary to thin wafers in the packaging process because of an industry trend to using thicker wafers in fabrication. This trend presents several problems in the packaging process. Thicker wafers require the more expensive complete saw-through method at die separation. Thicker wafers also require deeper die attach cavities, resulting in a more expensive package. Both of these undesirable results are avoided by thinning the wafers before die separation. It is also often necessary to remove, by wafer thinning, electrical junctions formed inadvertently on the back side of the wafer during fabrication.

Thinning steps generally take place between wafer sort and die separation. Wafers are reduced to a thickness of 0.2–0.5 mm. Thinning is done through mechanical grinding, mechanical polishing, or chemical-mechanical polishing. Wafer thinning or backgrinding has traditionally been a difficult process. In backgrinding there is the concern of scratching the front of the wafer and of wafer breakage. Stresses induced in the wafer by the grinding and polishing processes must be controlled to prevent heat induced wafer and die warping. Frequently, to secure a wafer 22 during a thinning operation, the wafer 22 is secured to a wafer chuck 26 with an adhesive sheet or film 24, see FIG. 10. However, heat generated during the thinning process subjects the adhesive sheet or film 24 to degradation and failure resulting in wafer damage. Accordingly, there is a need for a wafer processing apparatus that minimizes heat induced stress and damage during wafer thinning.

Wafer thinning done through mechanical grinding, mechanical polishing, or chemical-mechanical polishing often requires a plurality of wafer polishing or grinding disks to achieve a desired outcome. For example, it is often necessary to initiate wafer processing with a coarse grinding disk and complete the processing with a fine grinding disk. This requirement leads to corresponding increases in production time and equipment cost. Accordingly, there is a need for a wafer processing method wherein a single processing disk may be utilized where conventional methods utilize a series of processing disks.

BRIEF SUMMARY OF THE INVENTION

These needs are met by the present invention wherein a wafer processing apparatus and method of processing a wafer utilizing a processing slurry are provided.

In accordance with one embodiment of the present invention, a wafer processing disk is provided comprising a processing disk body having an outer periphery and a plurality of processing teeth secured to the processing disk body at the outer periphery of the disk body. The plurality of processing teeth project from the disk body to define respective processing surfaces. The plurality of processing teeth include at least one pair of spaced adjacent teeth defining a processing channel there between. The processing channel is shaped such that the cross sectional area of the processing channel decreases as a function of its distance from the processing disk body.

The cross sectional area of the processing channel may decrease continuously as a function of its distance from the processing disk body. The cross sectional area of the processing channel may decrease to a zero value. The processing disk body may define a substantially planar tooth mounting surface and the processing teeth may be mounted to the tooth mounting surface. The processing disk body may define a processing fluid passage and include at least one processing fluid port in fluid communication with the processing fluid passage, wherein the processing fluid port is positioned in the processing channel.

In accordance with another embodiment of the present invention, a wafer processing disk is provided wherein the plurality of processing teeth include at least one pair of spaced adjacent teeth having opposing walls inclined with respect to the processing surfaces such that the opposing walls define a processing channel decreasing in width as a function of its distance from the processing disk body.

In accordance with yet another embodiment of the present invention, a wafer processing disk is provided comprising a plurality of processing teeth wherein at least one of the processing teeth includes a subsurface channel spaced from the processing surface. The subsurface channel may be spaced from the processing surface in the direction of the processing disk body, may be bounded on one side by the disk body, and may extend through opposite sides of the processing tooth. A fluid port may be positioned in the subsurface channel.

In accordance with yet another embodiment of the present invention, a wafer processing disk is provided comprising a plurality of processing teeth, wherein spaced adjacent teeth define a processing channel there between and a fluid port is positioned in the processing channel. The spaced adjacent teeth have opposing walls defining the processing channel between the pair of spaced adjacent teeth. At least one of the opposing walls may follow a curved or inclined path. Preferably, one of the opposing walls follows the curved or inclined path and another of the opposing walls follows a path substantially perpendicular to the processing disk body.

In accordance with yet another embodiment of the present invention, a wafer processing disk is provided comprising a processing disk body having an outer periphery and a plurality of processing teeth secured to the processing disk body at the outer periphery of the disk body, wherein at least one of the plurality of processing teeth include a fluid passage extending from the processing disk body to one of the processing surfaces, and wherein a fluid port is positioned in the fluid passage. The fluid passage may be bounded at its periphery by the processing tooth and may comprise a bore in the processing tooth.

In accordance with yet another embodiment of the present invention, a wafer processing system is provided comprising a processing disk assembly, a mounted wafer assembly, and a driving assembly. The processing disk assembly includes a processing disk body having an outer periphery and a plurality of processing teeth secured to the processing disk body at the outer periphery of the disk body. Each of the plurality of processing teeth project from the disk body to define respective processing surfaces. The driving assembly is coupled to one or both of the processing disk assembly and the mounted wafer assembly and is operative to rotate one of the processing disk assembly and the mounted wafer assembly relative to the other of the processing disk assembly and the mounted wafer assembly. The driving assembly is preferably operative to impart rotary motion to the processing disk body. The driving assembly may further be operative to impart substantially linear reciprocating motion to the processing disk body. The mounted wafer assembly may comprise a wafer secured to a wafer receiving chuck.

In accordance with yet another embodiment of the present invention, a method of processing a wafer surface is provided comprising the steps of: positioning a processing disk adjacent the wafer surface;,causing the processing disk to move relative to the wafer surface; distributing a first processing slurry over the wafer surface as the processing disk moves relative to the wafer surface, wherein the first processing slurry comprises a first processing fluid and coarse processing particles, and wherein the coarse processing particles are urged against the wafer surface by the positioning and the movement of the processing disk; and distributing a second processing slurry over the wafer surface as the processing disk moves relative to the wafer surface, wherein the second processing slurry comprises a second processing fluid and fine processing particles, wherein the coarse processing particles are larger than the fine processing particles, and wherein the fine processing particles are urged against the wafer surface by the positioning and the movement of the processing disk.

The method may further comprise the step of distributing a third processing slurry over the wafer surface as the processing disk moves relative to the wafer surface, wherein the third processing slurry is selected from the group consisting of an abrasive slurry and a corrosive slurry. The first processing fluid, the second processing fluid, and the third processing fluid may be substantially identical. The coarse processing particles and the fine processing particles may be mechanically abrasive.

Accordingly, it is an object of the present invention to provide a wafer processing apparatus and a method of processing a wafer utilizing a processing slurry wherein the processing disk is provided with processing teeth designed to improve processing efficiency and wherein the method of processing the wafer utilizes a specially dispensed sequence of processing slurries over the wafer surface. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
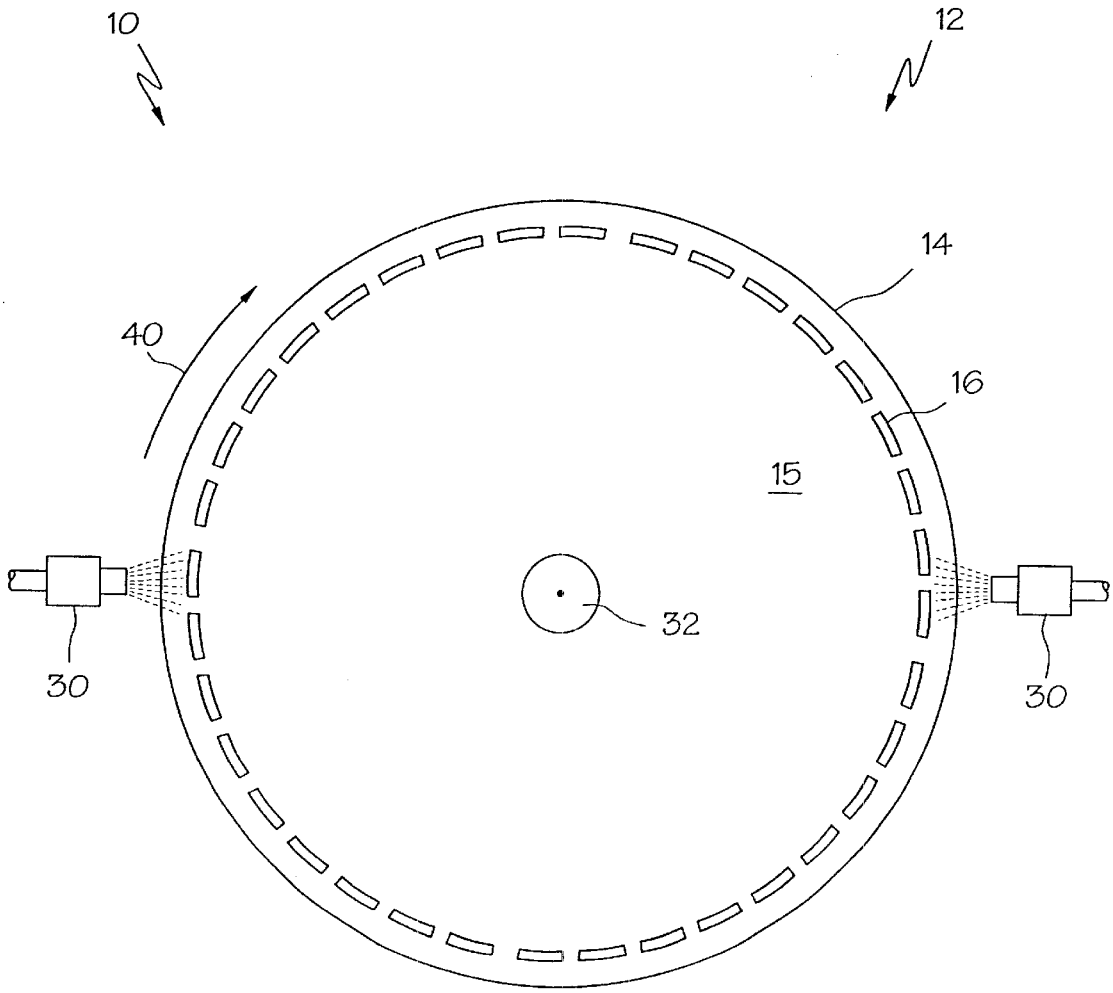
FIG. 1 is a schematic plan view of selected components of a wafer processing system according to the present invention.

Referring initially to FIG. 1, a wafer processing disk 12 and other selected components of a wafer processing system 10 according to the present invention are illustrated. The wafer processing disk 12 comprises a processing disk body 14 having an outer periphery and a plurality of processing teeth 16 secured to the processing disk body 14 at the outer periphery of the disk body 14. As will be appreciated by those skilled in the art practicing the present invention, the processing teeth 16 may be secured to the body 14 in a variety of ways and, preferably, comprise diamond grit supported in a resin matrix bonded directly to the processing disk body 14. Typically, the processing disk body 14 defines a substantially circular planar tooth mounting surface 15 and the processing teeth 16 are mounted or bonded to the tooth mounting surface 15. It is contemplated by the present invention, however, that a variety of disk geometries may be selected to embody the particular features of the present invention.

Referring now to FIGS. 2–9, the processing teeth 16 may be provided in any one of a variety of geometric arrangements. Although diamond grit supported by a resin matrix is particularly well suited for the formation of the various geometric arrangements according to the present invention, it is contemplated that other materials will be well suited for the formation of the processing teeth 16. Additionally, it is contemplated by the present invention that the processing teeth 16 may be formed integrally with the disk body 14 by machining the body 14 to form the teeth 16. The plurality of processing teeth 16 project from the disk body 14 to define respective processing surfaces 18. Spaced adjacent teeth 16 define processing channels 20 there between.

The processing channels 20 act as conduits for a processing slurry introduced as the processing disk 12 is brought into contact with a wafer 22 to be processed. As will be appreciated by those practicing the present invention, the processing slurry, including abrasive particles and a suspension agent, is introduced to facilitate wafer grinding or polishing. According to the present invention, the processing slurry may be introduced at the periphery of the disk 12 with, for example, spray injectors 30, see FIG. 1. Alternatively, the processing slurry may be introduced at the center of the disk 12 through a central port 32 and permitted to pass through the processing channels 20 as a result of the centrifugal force created when the disk 12 is rotating. The processing slurry may also be introduced adjacent the teeth 16 through fluid ports 34, as is described in further detail herein with reference to FIGS. 4 and 6–9.

The present inventor has recognized that one problem associated with processing disks 12 provided with processing slurry channels 20 is that circulation of the processing slurry through the channels 20 is inhibited and becomes less efficient as the teeth 16 on the processing disk 12 wear down. Specifically, as the teeth 16 wear down, the depth of the channels 20 between the teeth reduces and, as a result, the amount of processing fluid passing freely through the channel 20 is reduced. To partially compensate for this effect, the processing channels 20 are shaped such that the cross sectional area of the processing channel 20 decreases as a function of its distance from the processing disk body 14. As a result, the cross sectional area of the channels 20, in the immediate vicinity of the wafer 22, increases as the teeth 16 wear down. This increase in cross sectional area compensates for the loss in overall channel volume and preserves processing efficiency.

Figure 2:
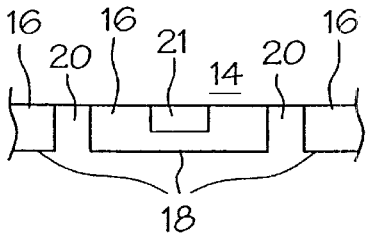
FIGS. 2–9 are schematic illustrations of a variety of processing teeth arrangements according to the present invention.
Figure 3:
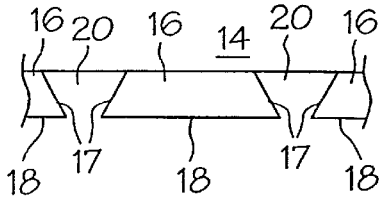
Figure 4:
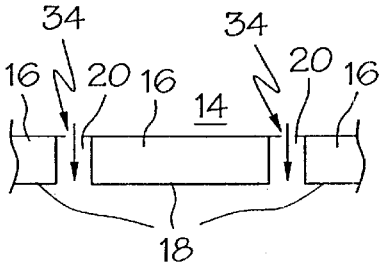

In the embodiment illustrated in FIG. 3, the cross sectional area of the processing channel 20 decreases continuously as a function of its distance from the processing disk body 14. In the embodiment of FIG. 2, the cross sectional area of the processing channel 20 decreases to a zero value as a function of its distance from the processing disk body 14. Referring specifically to FIG. 3 the spaced adjacent teeth 16 have opposing walls 17 inclined with respect to the processing surfaces 18 such that the opposing walls 17 define the decreasing width processing channels 20. Referring specifically to FIG. 2, the processing teeth 16 include subsurface channels 21 spaced from the processing surface 18 in the direction of the processing disk body 14. As clearly illustrated in FIGS. 2 and 6, the subsurface channel 21 terminates below the processing surface 18. Typically, each subsurface channel 21 is bounded on one side by the disk body 14 and extends through opposite sides of the processing tooth 16. It is contemplated by the present invention that a variety of other processing channel shapes, e.g., a stepwise or curved wall configuration, may be selected to compensate for the loss in the overall volume of the channel 20 as the teeth 16 wear down.

As is noted above, according to the embodiments of the present invention illustrated in FIGS. 4 and 6–9, processing fluid ports 34 are positioned in the processing channels 20. Specifically, the processing disk body 14 defines a processing fluid passage 36, see FIG. 10. Each processing fluid port 34 is in fluid communication with the processing fluid passage 36. In this manner, the processing slurry can be effectively introduced into the direct vicinity of the teeth 16. Additionally, referring to the embodiment of FIG. 6, a fluid port 34 is positioned in the subsurface channel 21.

Figure 5:
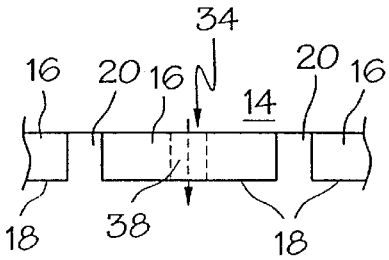
Figure 6:
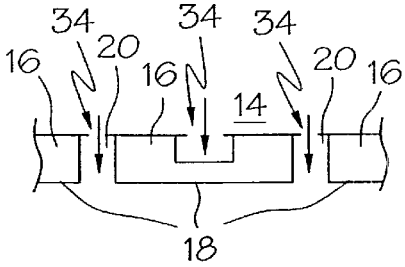
Figure 7:
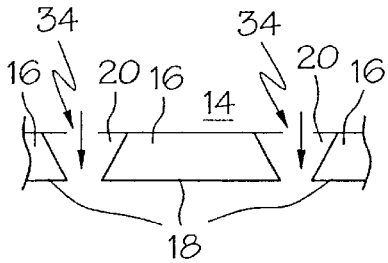

The embodiment of FIG. 5 illustrates another means by which the processing slurry can be effectively introduced into the direct vicinity of the teeth 16. Specifically, a processing tooth 16 may include a fluid passage 38 extending from the processing disk body 14 to the processing surface 18. A fluid port 34 is positioned in fluid communication with the fluid passage 38. Preferably, the fluid passage is bounded on its periphery by the material of the tooth 16, e.g., as a bore in the tooth 16.

Figure 8:
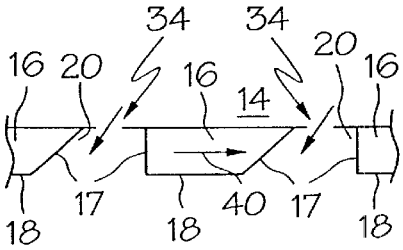
Figure 9:
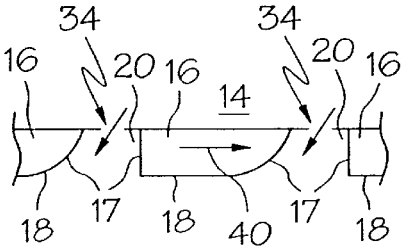

Referring now to FIGS. 8 and 9, a pair of processing teeth arrangements are described that provide for improved processing slurry flow as the processing disk 12 is rotated in the first rotary direction 40. Specifically, referring to FIG. 8, one of the opposing walls 17 defining the processing channel 20 follows an inclined path from the disk body 14 to one of the processing surfaces 18. The inclined path is directed away from the other opposing wall 17 opposite the first rotary direction 40. In the embodiment of FIG. 9, one of the opposing walls 17 follows a curved path from the disk 1X body 14 to one of the processing surfaces 18. The curved path curves away from the other opposing wall 17 opposite the first rotary direction 40.

Further components of the wafer processing system 10 will now be described with reference to FIG. 10. The wafer processing system 10 of FIG. 10 comprises the processing disk assembly 12, including the processing disk body 14 and the processing teeth 16, a mounted wafer assembly 42, and a driving assembly 28. The mounted wafer assembly comprises a wafer 22 secured to a wafer receiving chuck 26 with the adhesive film or tape 24. The driving assembly 28 is coupled to at least one, and preferably both, of the processing disk assembly 12 and the mounted wafer assembly 42 and is operative to rotate one, and preferably both, of the processing disk assembly 12 and the mounted wafer assembly 42. Where both the processing disk assembly 12 and the mounted wafer assembly 42 are rotated, they are typically rotated in opposite directions, as indicated by rotary arrows 46. It is contemplated by the present invention that the driving assembly may be further operative to impart substantially linear reciprocating motion to the processing disk 12 or the mounted wafer assembly 42. It is noted that the surface of the wafer 22 is typically slightly convex, and as such, the processing disk 12 may be constructed to complement the convex curve of the wafer 22 or may be allowed to wear down during processing to complement the convex curve of the wafer 22.

Figure 10:
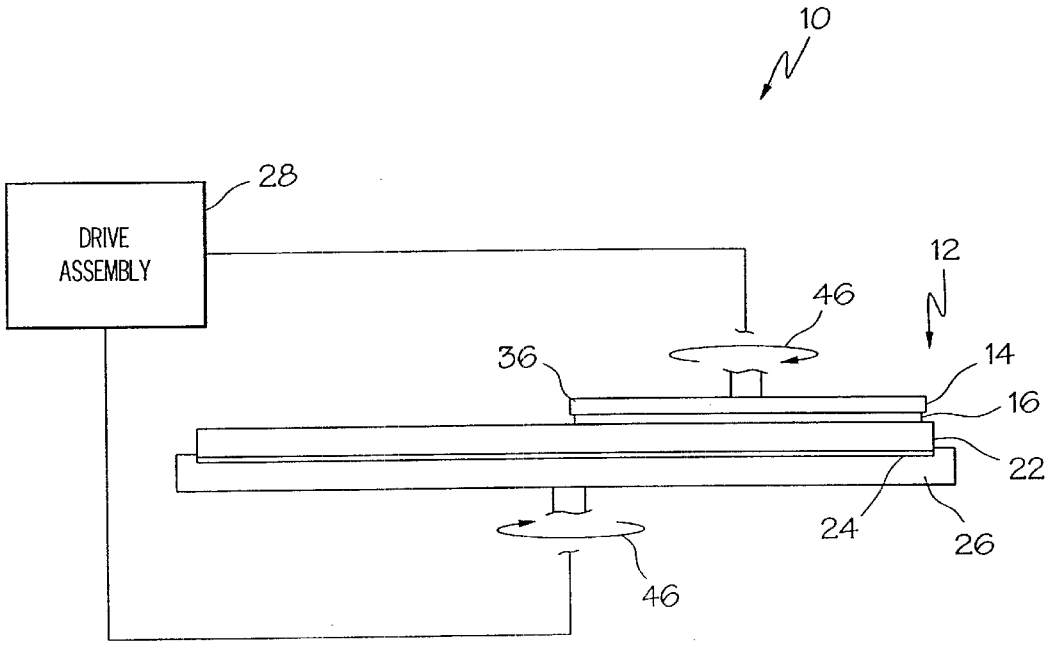
FIG. 10 is a schematic plan view of selected components of a wafer processing system according to the present invention, including a wafer to be processed.
Figure 11:
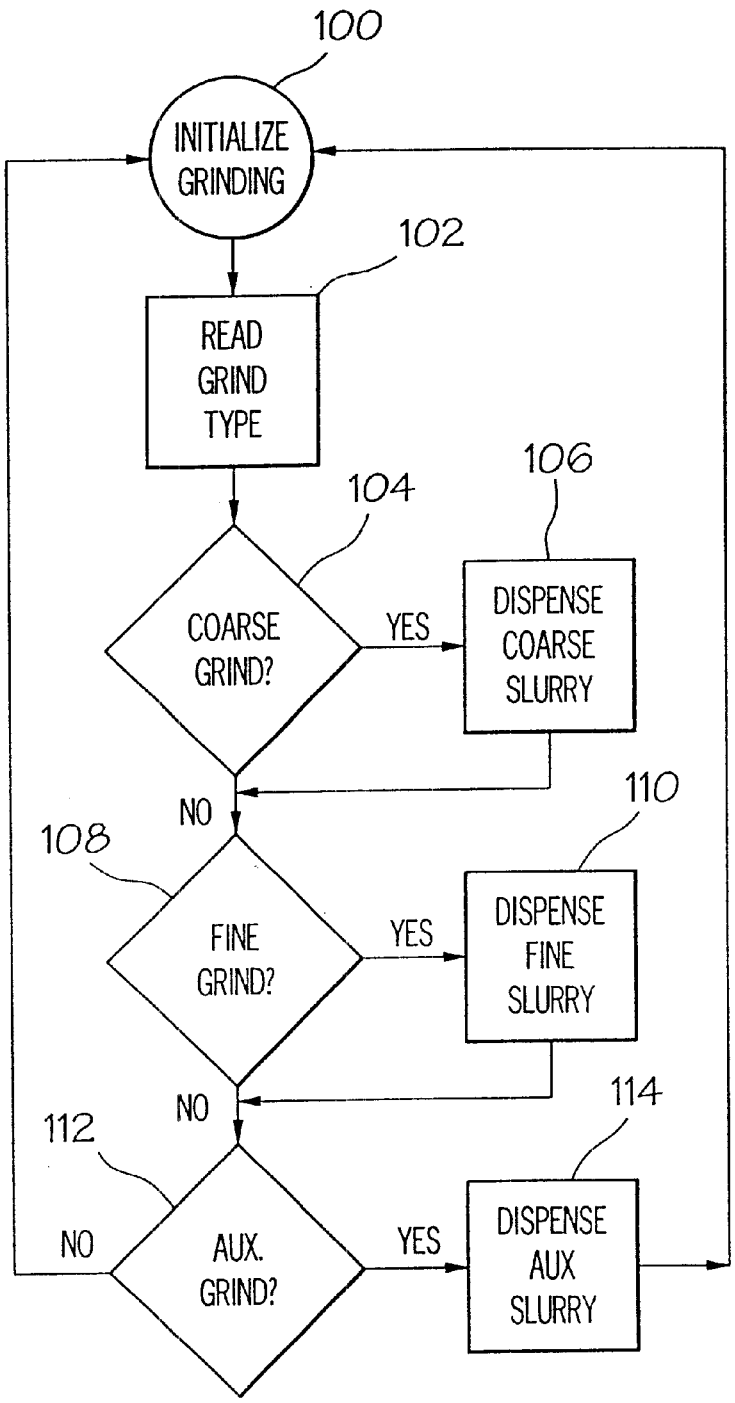
FIG. 11 is a flow chart illustrating a preferred wafer processing sequence according to the present invention.

Referring now to FIGS. 1, 10, and 11, a method of processing a wafer surface 23 is illustrated in detail. The processing or grinding operation is first initialized and predetermined grind parameters, e.g., rotation rates, coarse grind duration, fine grind duration, auxiliary grind duration, etc., are read or input, see steps 100, 102. The processing disk 12 is then positioned adjacent the wafer surface 23 and caused to rotate relative to the wafer surface 23. As is noted above, preferably, the driving assembly causes both the wafer 22 and the disk 12 to rotate in opposite directions. Depending upon the grind parameters or grind type read in step 102, a first processing slurry may be dispensed over the wafer surface 23 as the processing disk 12 moves relative to the wafer surface 23, see steps 104 and 106. According to a preferred embodiment of the present invention, the first processing slurry comprises a first processing fluid and coarse, mechanically abrasive, processing particles. The coarse is processing particles are urged against the wafer surface 23 by positioning the disk 12 adjacent the wafer surface 23 and rotating the processing disk 12. Next, again depending upon the grind parameters or grind type read in step 102, a second processing slurry may be dispensed over the wafer surface 23 as the processing disk 12 moves relative to the wafer surface 23. According to a preferred embodiment of the present invention, the second processing slurry comprises a second processing fluid and fine, mechanically abrasive, processing particles, see steps 108 and 110. The coarse processing particles are larger than the fine processing particles. Providing the slurries in this manner enables a single processing disk to be used for both coarse and fine wafer processing. According to a preferred embodiment of the present invention, the coarse processing particles comprise diamond particles having an average size of approximately 30 $\mu$m to approximately 60 $\mu$m, and the fine processing particles comprise diamond particles, typically, man-made, having an average size of approximately 3 $\mu$m to approximately 10 $\mu$m.

Further, referring now to steps 112 and 114, a third or auxiliary processing slurry may be dispensed over the wafer surface 23 as the processing disk 12 moves relative to the wafer surface 23. The third processing slurry may be an abrasive slurry that is more fine than the slurry dispensed in step 110, a corrosive slurry, or combinations thereof. The first processing fluid, the second processing fluid, and the third processing fluid may be substantially identical and may be selected from any of the variety of wafer processing fluids currently used in the art (e.g., water, hydrofluoric acid, nitric acid, hydrochloric acid, etc. It is contemplated by the present invention, however, that the nature of the specific processing fluids selected in each step may also change from application to application.

Having described the invention in detail and by reference to preferred embodiments thereof, it will be apparent that modifications and variations are possible without departing from the scope of the invention defined in the appended claims.

What is claimed is:

1. A wafer processing disk comprising:

a processing disk body having an outer periphery; and a plurality of processing teeth secured to said processing disk body at the outer periphery of said disk body, wherein each of said plurality of processing teeth project from said disk body to define respective processing surfaces, wherein at least one of said processing teeth includes a subsurface channel spaced from said processing surface and wherein said subsurface channel terminates below said processing surface.

2. A wafer processing disk as claimed in claim 1, wherein said subsurface channel is spaced from said processing surface in the direction of said processing disk body.

3. A wafer processing disk as claimed in claim 1, wherein said subsurface channel is bounded on one side by said disk body.

4. A wafer processing disk as claimed in claim 1, wherein said at least one processing tooth includes opposite sides and, wherein said subsurface channel extends through said opposite sides of said at least one processing tooth.

5. A wafer processing disk comprising:

a processing disk body having an outer periphery;

a plurality of processing teeth formed integrally with the processing disk body at the outer periphery of said disk body;

a plurality of channels, wherein each channel is formed between a pair of teeth of the plurality of processing teeth; and plurality of subsurface channels, wherein each subsurface channel is formed in one tooth of the plurality of processing teeth.

6. The wafer processing disk of claim 5, wherein the plurality of subsurface channels act as conduits for processing slurry.

7. A wafer processing disk comprising:

a processing disk body having an outer periphery;

a plurality of processing teeth formed with the processing disk body at the outer periphery of said disk body;

a plurality of channels, wherein each channel is between a pair of teeth of the plurality of processing teeth; and a plurality of subsurface channels, wherein each subsurface channel is formed in one tooth of the plurality of processing teeth and has a constant cross sectional area.

8. The wafer processing disk of claim 7, wherein each of the plurality of channels has a cross sectional area which decreases as a function of distance from said processing disk body.

9. The wafer processing disk of claim 7, wherein the plurality of processing teeth are formed integrally with the processing disk body.

10. The wafer processing disk of claim 7, wherein the plurality of processing teeth are formed on the processing disk body.

11. A wafer processing disk comprising:

a processing disk body having an outer periphery;

a plurality of processing teeth formed integrally with the processing disk body at the outer periphery of said disk body;

a plurality of channels, wherein each channel is between a pair of teeth of the plurality cf processing teeth; and a plurality of fluid passages, wherein each fluid passage is formed in one tooth of the plurality of processing teeth.

12. The wafer processing disk of claim 11, wherein the plurality of fluid passages permit fluid to flow to a surface of the plurality of processing teeth.

13. The wafer processing disk of claim 11, wherein the processing disk body includes a plurality of fluid ports, each adjacent to one of the plurality of fluid passages.

14. The wafer processing disk of claim 13, wherein the plurality of fluid ports are positioned in fluid communication with the plurality of fluid passages.

15. A wafer processing disk comprising:

a processing disk body having an outer periphery and a plurality of fluid ports;

a plurality of processing teeth formed integrally with the processing disk body at the outer periphery of said disk body;

a plurality of fluid passages, each passage formed in one tooth of the plurality of processing teeth and positioned in fluid communication with one of the plurality of fluid ports.

16. The wafer processing disk of claim 15, further comprising:

a plurality of channels, wherein each channel is formed between a pair of teeth of the plurality of processing teeth.

17. The wafer processing disk of claim 15, wherein fluid flows to a surface of the teeth from the plurality of fluid ports.

18. A wafer processing disk comprising:

a processing disk body having an outer periphery;

a plurality of processing teeth defining respective processing surfaces and formed integrally with the processing disk body at the outer periphery of said disk body, wherein each tooth of the plurality of processing teeth have sidewalls; and a plurality of channels, wherein each channel is formed between the sidewalls of a pair of teeth of the plurality of processing teeth, and wherein the sidewalls are at an angle such that a width of the plurality of processing teeth near the processing disk body is smaller than a width of the plurality of processing teeth at a processing surface of the plurality of processing teeth.

19. The wafer processing disk of claim 18 further comprising a plurality of subsurface channels, wherein each subsurface channel is formed in one tooth of the plurality of processing teeth.

20. A wafer processing disk comprising:

a processing disk body having an outer periphery;

a plurality of processing teeth defining respective processing surfaces and formed integrally with the processing disk body at the outer periphery of said disk body, wherein each tooth of the plurality of processing teeth have sidewalls; and a plurality of channels, wherein each channel is formed between the sidewalls of a pair of teeth of the plurality of processing teeth, and wherein the sidewalls are at an angle such that wear on the plurality of teeth increases a cross sectional area of the plurality of channels at said respective processing surfaces.

* * * * *

UNITED STATES PATENT AND TRADEMARK OFFICE

CERTIFICATE OF CORRECTION

PATENT NO. : 6,443,822 B1
DATED : September 3, 2002
INVENTOR(S) : Michael Bryan Ball It is certified that error appears in the above-identified patent and that said Letters Patent is hereby corrected as shown below:

Title page,
Item [75], Inventor, reads as "Michael Byan Ball" should read
-- Michael Bryan Ball --.

Column 3,
Line 31, reads as "surface;, causing" should read -- surface; causing --.

Column 5,
Line 64, reads as "disk 1X body 14" should read -- disk body 14 --.

Column 6,
Line 39, reads as "The coarse is processing" should read -- The coarse processing --.

Column 7,
Line 1, reads as "hydrochloric acid, etc." should read -- hydrochloric acid, etc. --.

Signed and Sealed this

Eleventh Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,443,822 B1
DATED : September 3, 2002
INVENTOR(S) : Michael Bryan Ball It is certified that error appears in the above-identified patent and that said Letters Patent is hereby corrected as shown below:

Title page,
Item [75], Inventor, reads as "Michael Byan Ball" should read
-- Michael Bryan Ball --.

Column 3,
Line 31, reads as "surface;, causing" should read -- surface; causing --.

Column 5,
Line 64, reads as "disk 1X body 14" should read -- disk body 14 --.

Column 6,
Line 39, reads as "The coarse is processing" should read -- The coarse processing --.

Column 7,
Line 1, reads as "hydrochloric acid, etc." should read -- hydrochloric acid, etc.) --.

This certificate supersedes Certificate of Correction issued November 11, 2003.

Signed and Sealed this

Twenty-fifth Day of May, 2004

JON W. DUDAS
*Acting Director of the United States Patent and Trademark Office*